US009627836B2

(12) United States Patent
Marble

(10) Patent No.: US 9,627,836 B2
(45) Date of Patent: Apr. 18, 2017

(54) SMALL FORM PLUGGABLE INSERTION/REMOVAL TOOL

(71) Applicant: Cisco Technology, Inc., San Jose, CA (US)

(72) Inventor: Warren Marble, Sandown, NH (US)

(73) Assignee: Cisco Technology, Inc., San Jose, CA (US)

( * ) Notice: Subject to any disclaimer, the term of this patent is extended or adjusted under 35 U.S.C. 154(b) by 264 days.

(21) Appl. No.: 14/307,348

(22) Filed: Jun. 17, 2014

(65) Prior Publication Data

US 2015/0364894 A1 Dec. 17, 2015

(51) Int. Cl.
*H01R 43/26* (2006.01)
*B25B 27/00* (2006.01)

(52) U.S. Cl.
CPC ..... *H01R 43/26* (2013.01); *B25B 27/00* (2013.01); *Y10T 29/53257* (2015.01)

(58) Field of Classification Search
CPC .... G02B 6/36; G02B 6/38; G02B 6/40; B25B 27/00; H01R 43/26; Y10T 29/53257
See application file for complete search history.

(56) References Cited

U.S. PATENT DOCUMENTS 5,777,413 A * 7/1998 Nagata ..... F16C 17/08 310/156.25
2003/0178897 A1* 9/2003 Jun ..... H02K 7/081 310/90

FOREIGN PATENT DOCUMENTS

JP 2612840 B2 * 5/1997
JP 2014076499 A * 5/2014

* cited by examiner

*Primary Examiner* — Carl Arbes
(74) *Attorney, Agent, or Firm* — Polsinelli PC

(57) ABSTRACT

A SFP tool can include a tool body with an installer key slidingly engaged with the tool body and/or an extractor key slidingly engaged with the tool body. The installer key can include one or more port engagers at a distal end of the installer key to engage with one or more corresponding ports in a SFP for installing the SFP into a SFP slot in a networking device. To remove a SFP from a SFP slot of a networking device, a bail engager pivotally coupled to an extractor key at a distal end of the extractor key can be engage and unlock a bail on the SFP. The SFP can be removed by moving a extractor key handle away from the networking device and/or the pressure can be applied to the extractor key handle and the SFP tool can be pulled away from the networking device.

15 Claims, 10 Drawing Sheets

SMALL FORM PLUGGABLE INSERTION/REMOVAL TOOL

TECHNICAL FIELD

The present technology pertains to a small form pluggable (SFP) tool, and more specifically pertains to a SFP tool for inserting a SFP into a networking device and/or removing a SFP from a networking device.

BACKGROUND

SFPs are widely used for data and network communications. Each SFP typically has a socket connector at one end and two ports at the other end. The socket connector can communicatively couple the SFP to a networking device, such as a switch, router or other media converter. The ports communicatively couple the SFP to another device via cables. The ports can be data or optical ports and the cables can be copper cables or fiber optic cables. The SFP can reside in a SFP slot of a networking device. A networking device can have multiple SFP slots and multiple networking devices can reside in a rack system. In such environments, the number of cables can be overwhelming. For example, if each SFP slot has two cables and each networking device has fifty (50) slots, there can be a hundred (100) cables. If the rack system has more networking devices, there can be even more cables. As a result, installing and/or removing a SFP from a SFP slot of a networking device can be difficult given the limited space due to the cables.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings.

DESCRIPTION

Figure 1:
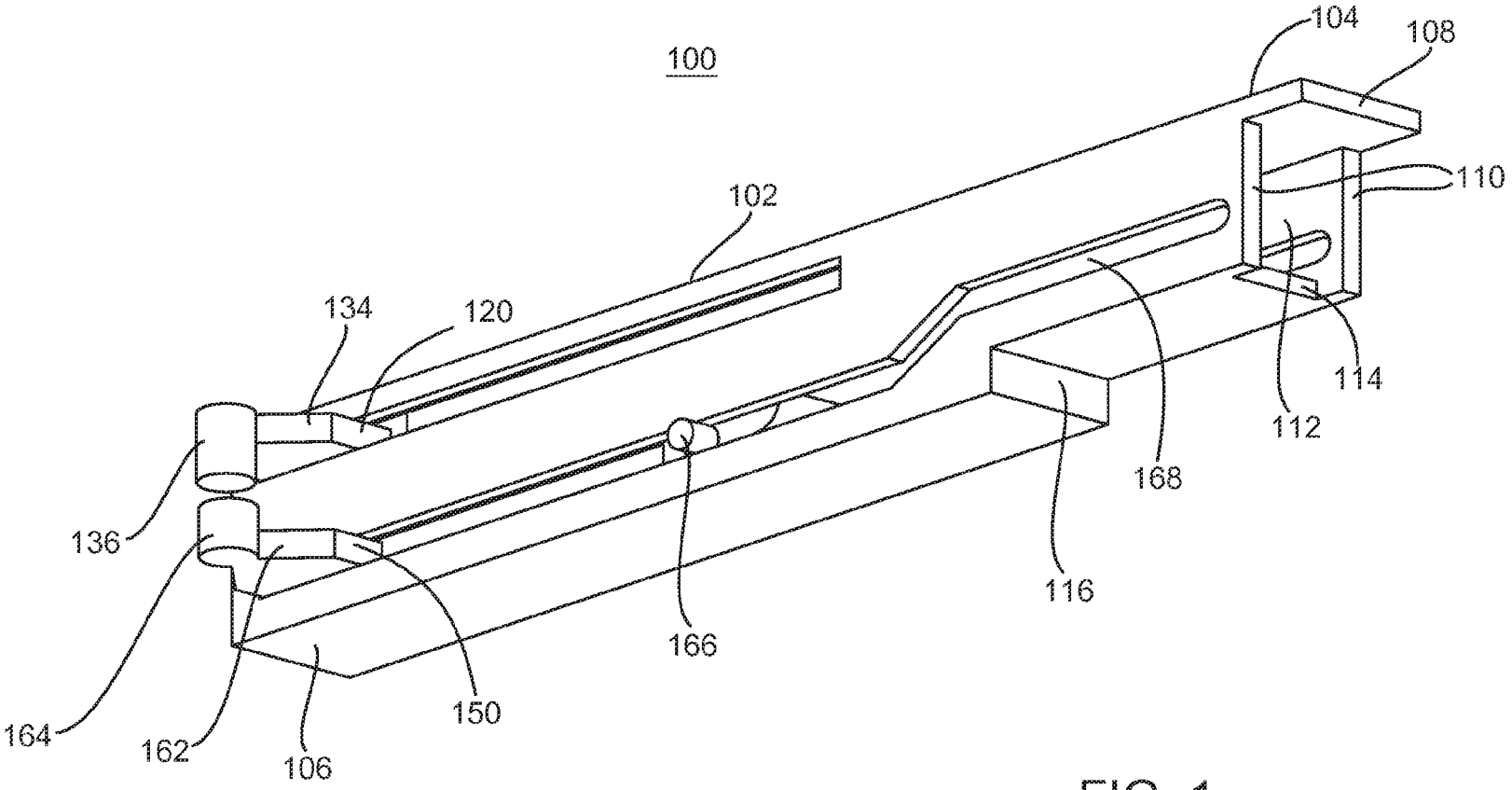
FIG. 1 illustrates a perspective view of a SFP tool in accordance with an exemplary embodiment.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

As used herein the term "SFP" shall be considered to interchangeably be used to refer to a small form pluggable, small form-factor pluggable or SFP transceiver.

Overview: A SFP tool and methods for using the SFP tool are disclosed herein. The SFP tool can include a tool body with an installer key slidingly engaged with the tool body and/or an extractor key slidingly engaged with the tool body. The installer key can include one or more port engagers at a distal end of the installer key. The one or more port engagers can be adapted to engage with one or more corresponding ports in a SFP for installing the SFP into a SFP slot of a networking device. The SFP can be coupled with the one or more port engagers and can be partially slid into the main body of the SFP tool prior to installing the SFP into the SFP slot of the networking device. Once the coupled SFP is aligned with the SFP slot, an installer key handle can be slid towards the networking device causing the SFP to slide into an SFP slot of the networking device. To remove a SFP from a SFP slot of a networking device, a bail engager pivotally coupled to an extractor key at a distal end of the extractor key can be moved to engage a bail on the SFP. For example, an extractor key handle can be moved in an extended position causing the bail engager to pivot into an engagement position with the bail engager engaging the bail of the SFP. To unlock the bail, the extractor key handle can be moved away from the networking device and/or the pressure can be applied to the extractor key handle and the SFP tool can be pulled away from the networking device. Once the bail is unlocked, the extractor key handle can be slid away from the networking device to remove the SFP from the networking device and/or the SFP tool can be pulled away from the networking device.

The disclosed technology addresses the need in the art for a tool that can be used to insert a SFP into a SFP slot of a networking device and/or remove a SFP from a SFP slot of a networking device. Given the limited space around the SFP slots of a networking device when the networking device is filled or partially filled with SFPs and the amount of cables coupled to the SFPs, it can be difficult to insert a SFP into a SFP slot of the networking device and/or remove a SFP from a SFP slot of the networking device. The SFP tool can make the insertion process and/or removal process easier because of the size of the SFP tool compared to a user's hand.

Referring to FIGS. 1-6, various perspective views of a SFP tool in accordance with exemplary embodiments are illustrated. As shown the SFP tool 100 can include a tool body 102 having a first distal end 104 and a second distal end 106. In some embodiments, the tool body 102 can have smaller dimensions near the first distal end 104 compared to the dimensions near the second distal end 106. To reduce the dimensions, the tool body 102 can include a step 116 as shown. In other embodiments, the tool body 102 can be tapered to reduce the dimensions. By having smaller dimensions near the first distal end 104, the SFP tool 100 can fit into smaller areas near the networking device to insert and/or remove a SFP from a SFP slot of a networking device. The tool body 102 can include an alignment component 108 extending from the first distal end 104 of the tool body 102. The alignment component 108 can assist in aligning the SFP tool 100 during installation and/or removal of a SFP from a networking device. The alignment component 108 can extend beyond the side walls 110 of the tool body 102 as shown. The SFP tool 100 can include an installer key 120 for engaging with at least one port of a SFP during installation of the SFP into a networking device. The SFP tool 100 can include an extractor key 150 for engaging with a bail of a SFP during removal of the SFP from a networking device.

Figure 2:
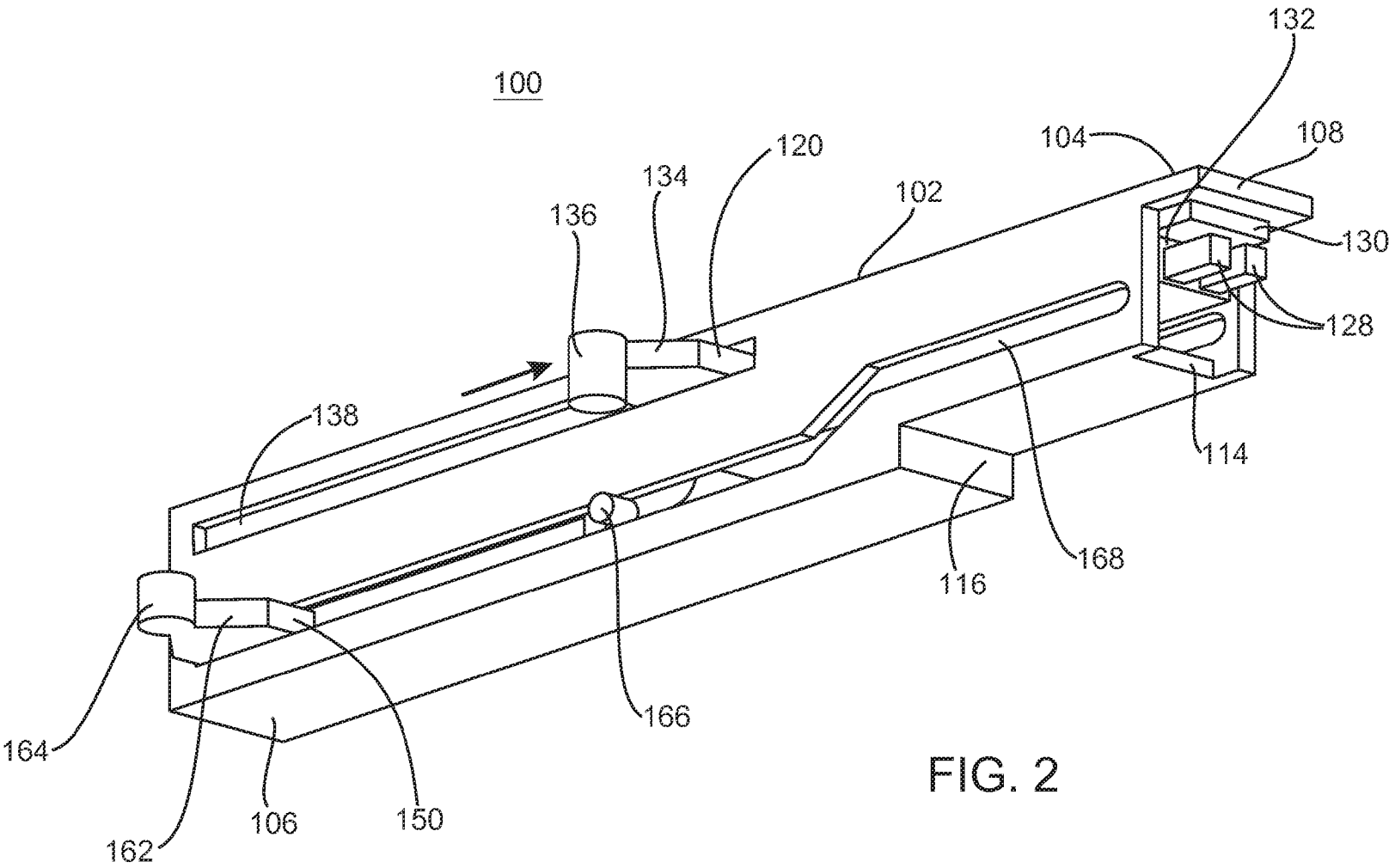
FIG. 2 illustrates a perspective view of a SFP tool with an installer key in an extended position in accordance with an exemplary embodiment.
Figure 3:
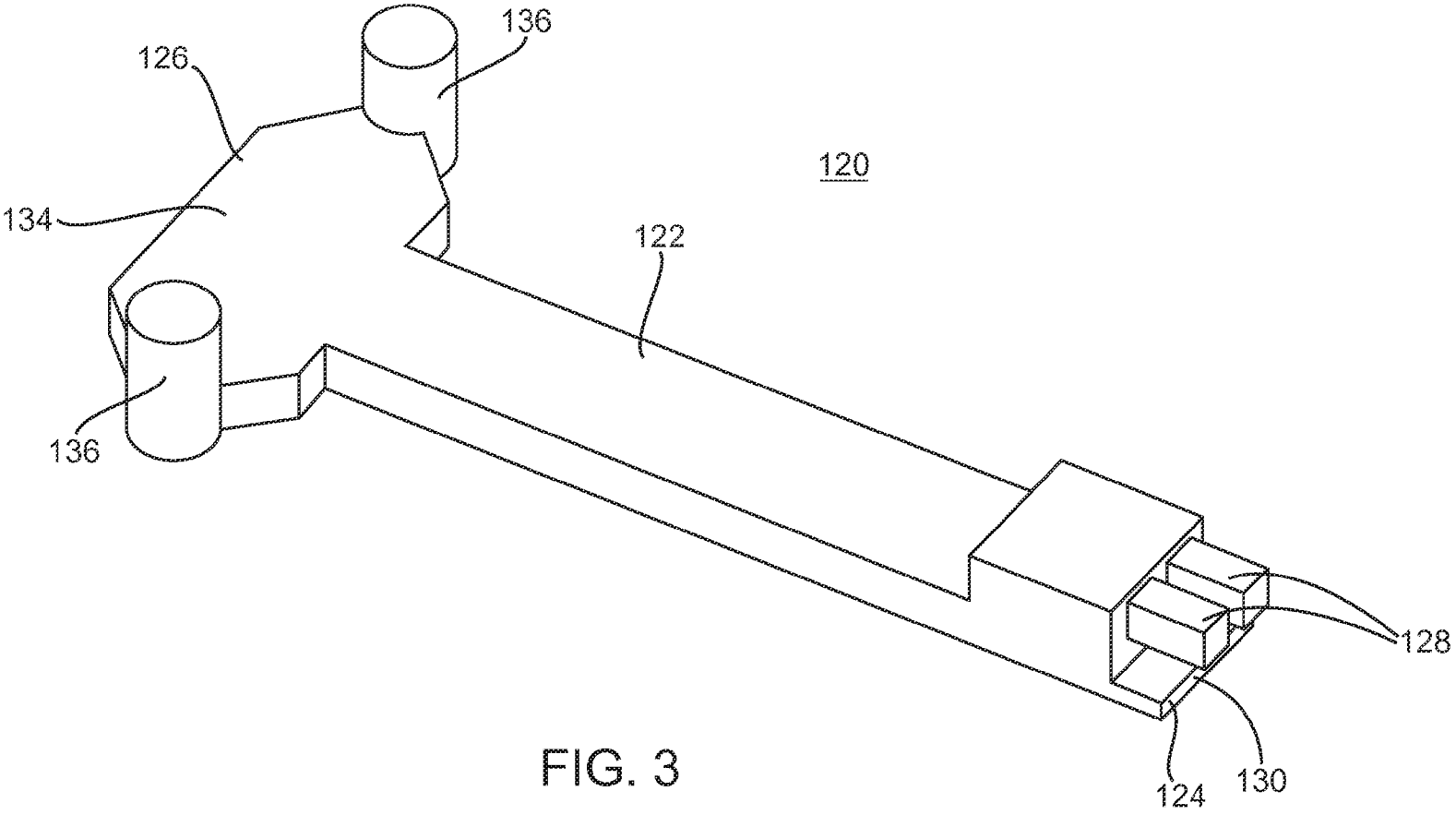
FIG. 3 illustrates a perspective view of an installer key in accordance with an exemplary embodiment.

Referring to FIGS. 2 and 3, the installer key 120 can include a main body 122, a first distal end 124 and a second distal end 126. The installer key 120 can be, but is not limited to, one piece. The installer key 120 can include at least one port engager 128 at about the first distal end 124 of the installer key 120. Each port engager 128 can be adapted to engage with a corresponding port in a SFP. More specifically, each port engager 128 can be shaped and sized to fit within a corresponding port in the SFP. For example, as shown, each port engager 128 can be square shaped and sized to fit within a corresponding port in the SFP. The SFP port engager 128 can extend out of the first distal end 124 of the installer key 120. The installer key 120 can include a protrusion 130 at about the first distal end 124 of the installer key 120. As shown, the protrusion 130 can extend away from the main body 122 of the installer key 120 and can be parallel with the one or more port engagers 128. The protrusion 130 and the one or more port engagers 128 can be spaced apart to form a gap 132. More specifically, the protrusion 130 and the one or more port engagers 128 can be spaced apart to permit a surface of a SFP, the section of the SFP between the one or more corresponding ports and an exterior surface of the SFP, to reside in the gap 132 when a SFP is coupled to the SFP tool thereby assisting to retain the SFP during installation. The one or more port engagers 128, and/or the protrusion 130 in conjunction with the one or more port engagers 128, can assist in maintaining the orientation of a SFP coupled with the SFP tool when the SFP is being installed in a networking device. The installer key 120 can include an installer key handle 134. As shown, the installer key handle 134 can be at second distal end 126 of the installer key 120. By having the installer key handle 134 at the second distal end 126, the installer key handle 134 can provide the most leverage. In some embodiments, the installer key handle 134 can be located on other parts of the main body 122 of the installer key 120. As discussed in further detail below, the installer key handle 134 can include one or more retaining posts 136 on each side of the installer key handle 134.

As shown in FIGS. 1 and 2, the installer key 120 can be slidingly engaged with the tool body 102. The installer key 120 can have a retained position and an extended position. In the retained position, the entire installer key 120, excluding part of the installer key handle 134, can reside within a cavity 112 formed within the tool body 102 as shown in FIG. 1. The cavity 112 can be sized to allow a coupled SFP to fit within the cavity 112 during installation and/or removal of the SFP. In the extended position, at least a portion of the installer key 120 can extend out of the tool body 102 as shown in FIG. 2. For example, the port engager 128 can extend out of the tool body 102 in an extended position. The installer key handle 134 can be used to move the installer key 120 between the retracted position and the extended position. The tool body 102 can include an installer key slot or channel 138 on corresponding sides 110 of the tool body 102 with at least part of the installer key handle 134 extending out of each channel 138. As a result, a user can grip the installer key handle 134 and slide the installer key 120 with respect to the tool body 102. The installer key 120 and the corresponding channels 138 can each be sized to assist in retaining the installer key 120 within the tool body 102 and the first distal end 124 of the installer key 120 extending out of the first distal end 104 of the tool body 102. The one or more retaining posts 136 on the installer key handle 134 can assist in retaining the installer key 120 within the tool body 102. The width of the installer key 120 can be less than the interior width of the tool body 102 (the width between the two sides 110) to allow the installer key 120 to slide within the tool body 102 and to assist in retaining the installer key 120 within the tool body 102.

Figure 4:
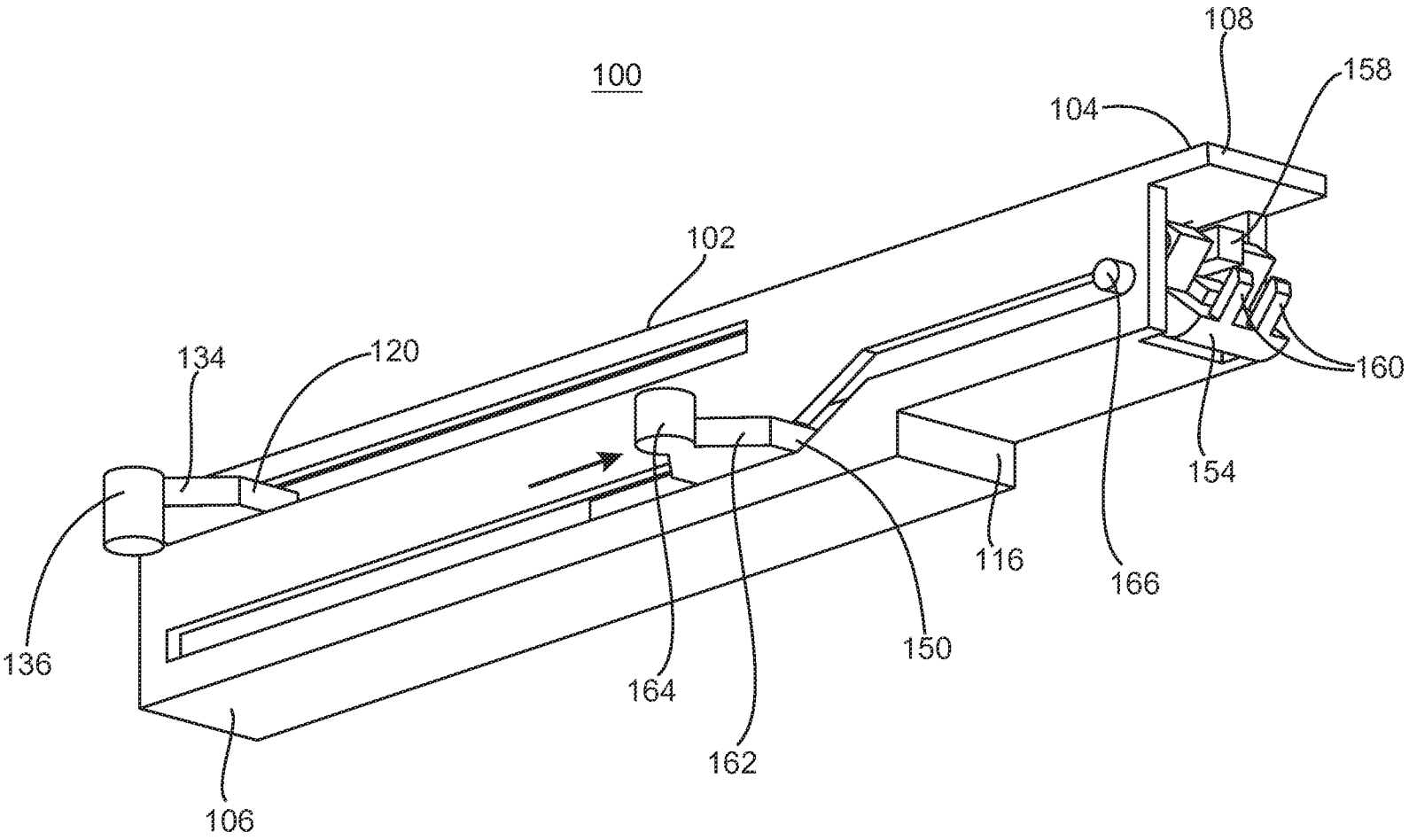
FIG. 4 illustrates a perspective view of a SFP tool with a bail engager in an engagement position in accordance with an exemplary embodiment.
Figure 5:
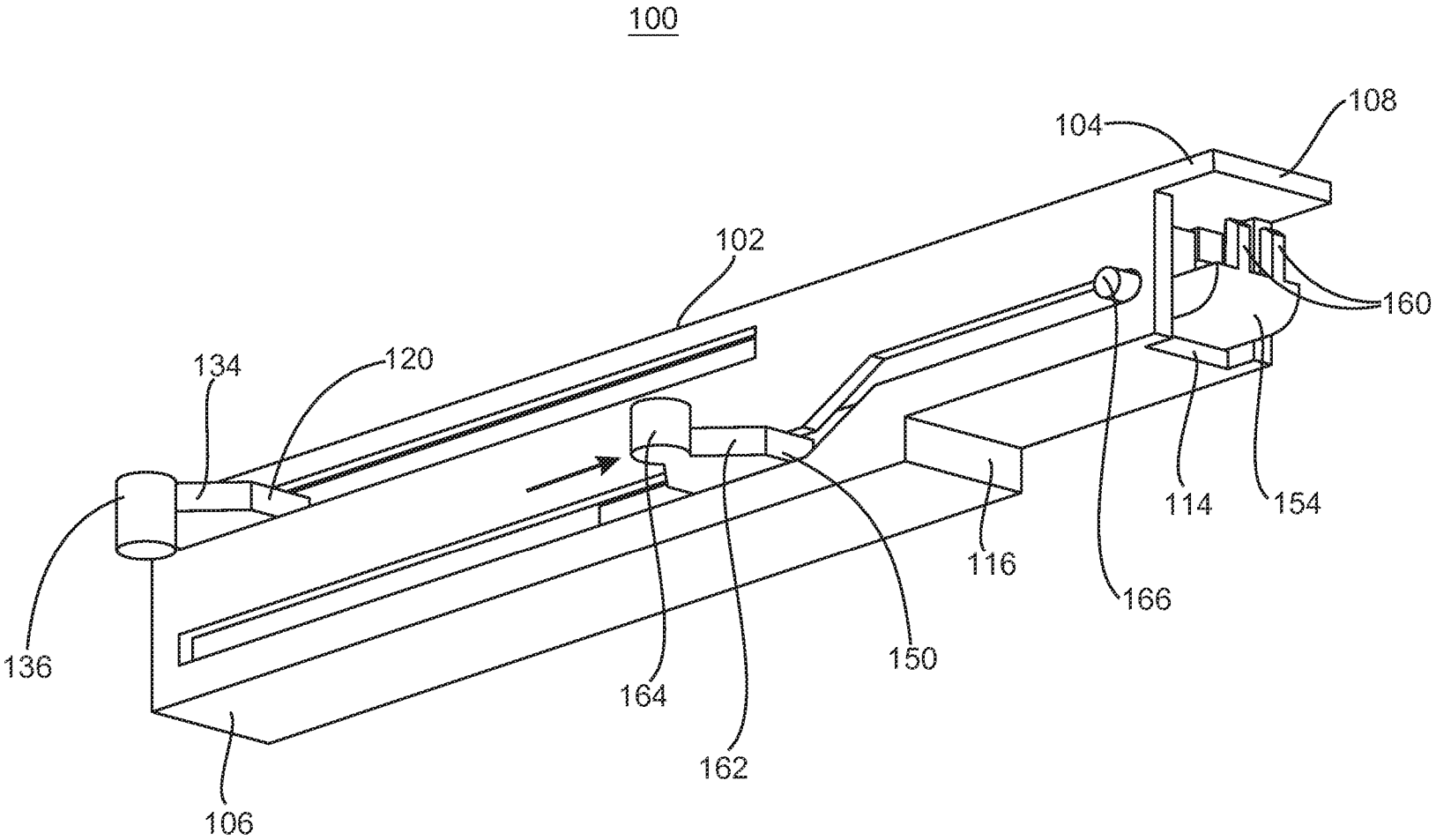
FIG. 5 illustrates a perspective view of a SFP tool with a bail engager in a retention position in accordance with an exemplary embodiment.
Figure 6:
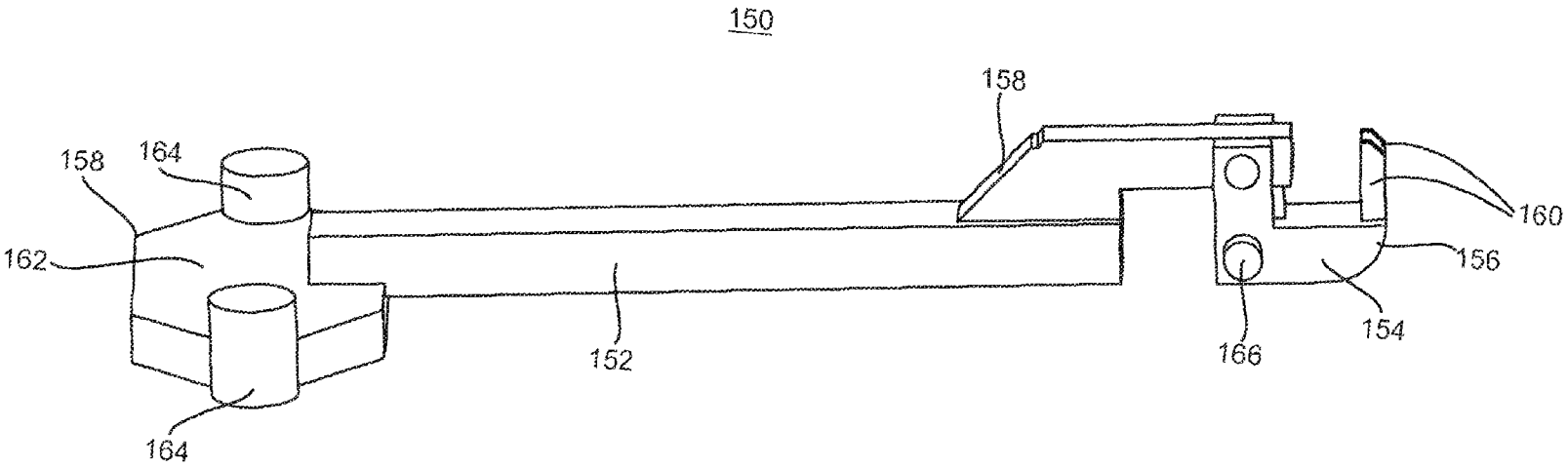
FIG. 6 illustrates a perspective view of an extractor key in accordance with an exemplary embodiment.

Referring to FIGS. 4-6, the extractor key 150 can have a main body 152, a bail engager 154, a first distal end 156 and a second distal end 158. In some embodiments, the extractor key 150 can have more components. As shown, the main body 152 can be pivotally coupled with the bail engager 154. The bail engager 154 can be at about a first distal end 156 of the extractor key 150. The main body 152 can be pivotally coupled with the bail engager 154 using known techniques. For example, an extension arm 158 can pivotally couple the bail engager 154 with the main body 152 as shown in FIG. 6. In such embodiments, the extension arm 158 can be matingly coupled to the bail engager 154 using a hole (not shown) in the extension arm 158 and a corresponding hole (not shown) in the bail engager 154 with a connecting rod (not shown) connecting the two. The bail engager 154 can be adapted to engage with a bail of a SFP during removal of the SFP from a networking device. For example, the bail engager 154 can have one or more grasping elements 160 adapted to grasp the bail of SFP in the locked position and to pull the bail downward thereby unlocking the bail from the networking device.

To permit the bail engager 154 to pivot, the tool body 102 can include an indent 114 to allow the bail engager 154 to pivot as shown in FIGS. 3 and 4. The bail engager 154 can include one or more channel posts 166 on each side of the bail engager 154. In some embodiments, the one or more channel posts 166 can be located on other parts of the extractor key 150. The extractor key 150 can include an extractor key handle 162. As shown, the extractor key handle 162 can be at second distal end 158 of the extractor key 150. By including the extractor key handle 162 at the second distal end 158, the extractor key handle 162 can provide the most leverage. In some embodiments, the extractor key handle 162 can be located on other parts of the main body 152 of the extractor key 150. The extractor key handle 162 can include one or more retaining posts 166 on each side of the extractor key handle 162.

As shown in FIGS. 1 and 4-6, the extractor key 150 can be slidingly engaged with the tool body 102. The extractor key 150 can have a retained position, an engagement position and a retention position. In the retained position, the entire extractor key 150, excluding part of the extractor key handle 162 and the one or more channel posts 166, can reside within the tool body 102 as shown in FIG. 1. In the engagement position, at least a portion of the extractor key 150 can extend out of the tool body 102 with the bail engager 154 pivoting at an angle as shown in FIG. 4. For example, the bail engager 154 can extend out of the tool body 102 with the bail engager 154 pivoting at an angle to engage with a bail of a SFP. In the retained position, at least a portion a portion of the extractor key 150 can extend of out of the tool body 102 with the bail engager 154 approximately level with the rest of the extractor key 150 as shown in FIG. 5. For example, the bail engager 154 can extend out of the tool body 102 with the bail engager at no angle which allows the bail engager 154 to retain the bail of a SFP. The extractor key handle 162 can be used to move the extractor key 150 between the retracted position engagement position and retention position. The tool body 102 can include an extractor key slot or channel 168 on corresponding sides of the tool body 102 with the extractor key handle 162 extending out of each channel 168 and one or more channel posts 166 extending out of each channel 168. By having the extractor key handle 150 extend outside of the tool body 102, a user can grip the extractor key handle 150 and slide the extractor key 150 with respect to the tool body 102. The extractor key 150 and the corresponding extractor key channels 168 can each be sized to assist in retaining the extractor key 150 within the tool body 102 and that the first distal end 156 of the extractor key 150 extends out of the first distal end 104 of the tool body 102.

In some aspects, one or more retaining posts 166 on the extractor key handle 162 can assist in retaining the extractor key 150 within the tool body 102. The one or more retaining posts 166 can cause the bail engager 154 to pivot when the one or more retaining posts 166 are at the end of the extractor key channels 168 as shown in FIGS. 4 and 5. For example, when the extractor key 150 is slid forward towards the networking device, the one or more retaining posts 166 slid forward in the extractor key channels 168. When the one or more retaining posts 166 reach the end of the retaining posts 166 as shown in FIG. 5, the bail engager 154 can be level with the extractor key 150. When additional pressure is applied to the extractor key handle 162, the bail engager 154 can pivot causing the bail engager 154 to become angled as shown in FIG. 4. When the extractor key 150 is slid away from the networking device, the bail engager 154 can be level with the extractor key 150 as shown in FIG. 5. The width of the extractor key 150 can be less than the interior width of the tool body 102 (the width between the two sides 110) to allow the extractor key 150 to slide with the tool body 102 and to assist in retaining the extractor key 150 within the tool body 102.

Regarding the installer key channels 138 and the extractor key channels 168, the length of each of the channels 138, 168 are each of sufficient length to have the installer key 134 and the extractor key 162 fully retained within the tool body 102 when the installer key 134 and the extractor key 162 are each in the retained position. Due to the step 116, the extractor key channel 168 is angled. In some embodiments, the installer key 134 and extractor key 162 can be switched with the installer key channel 138 having an angle and the extractor key channel 168 being substantially straight. In other embodiments, the step 116 can be removed. In such embodiments, the installer key channels 138 and the extractor key channels 168 can be substantially straight. However, in such embodiments, the cavity 112 would be larger which can cause additional stress on the one or more port engagers 128 and the protrusion 130 due to a connected SFP oriented at a bigger angle compared to a tool body 102 having a smaller cavity 112.

Figure 7:
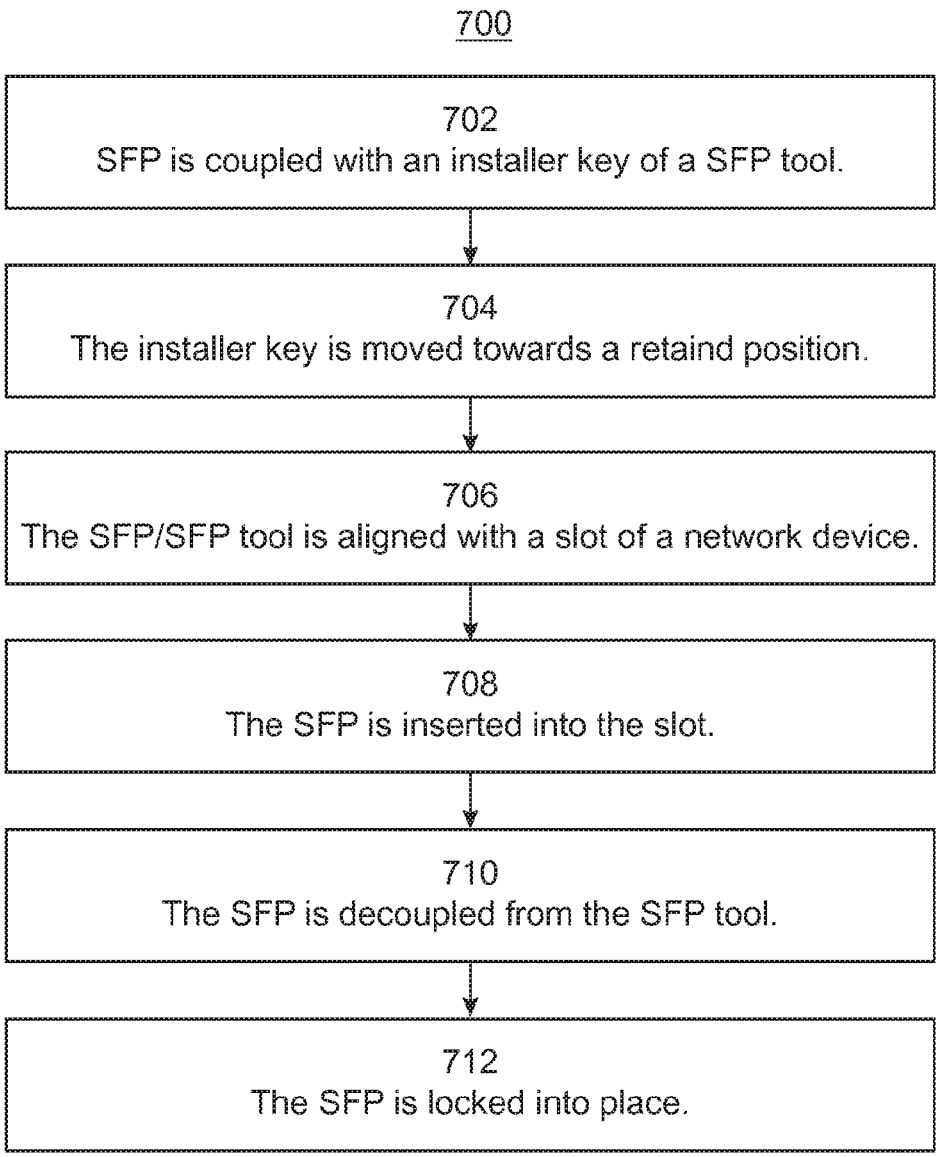
FIG. 7 illustrates a flow diagram for inserting a SFP into a networking device using a SFP tool in accordance with an exemplary embodiment.

Referring to FIG. 7, a flowchart for inserting a SFP into a networking device in accordance with an exemplary embodiment is illustrated. The exemplary method 700 is provided by way of example, as there are a variety of ways to carry out the method. The method 700 described below can be carried out using the SFP tool illustrated in FIGS. 1-6 by way of example, and various elements of these figures are referenced in explaining exemplary method 700. Each block shown in FIG. 7 represents one or more processes, methods or subroutines, carried out in the exemplary method 700. The exemplary method 700 can begin at block 702.

At block 702, a SFP is coupled with an installer key of an SFP tool. For example, the one or more port engagers 128 of the installer key 120 of the SFP tool 100 can be inserted into corresponding ports on the SFP. In addition, the bottom section, the section between the corresponding ports on the SFP and the bottom surface of the SFP, can be inserted into the gap 132 of the SFP tool 100. After the SFP is coupled with the insertion key, the method 700 can proceed to block 704.

At block 704, the installer key is moved towards a retained position. For example, the installer key 120 can be moved towards the retained position which allows the SFP to be partially retained in the cavity 112 of tool body 102. By having the SFP partially retained within the SFP tool 100, the SFP/SFP tool 100 can be easier to move around and align. After moving the installer key 120 towards the retained position, the method 700 can proceed to block 706.

At block 706, the SFP/SFP tool is aligned with a slot of a networking device. For example, a user can align the alignment component 108 of the SFP tool 100 with a slot or SFP slot of a networking device that the SFP is going to be inserted into. After aligning the SFP/SFP tool 102 with the slot of the networking device, the method 700 can proceed to block 708.

Figure 8:
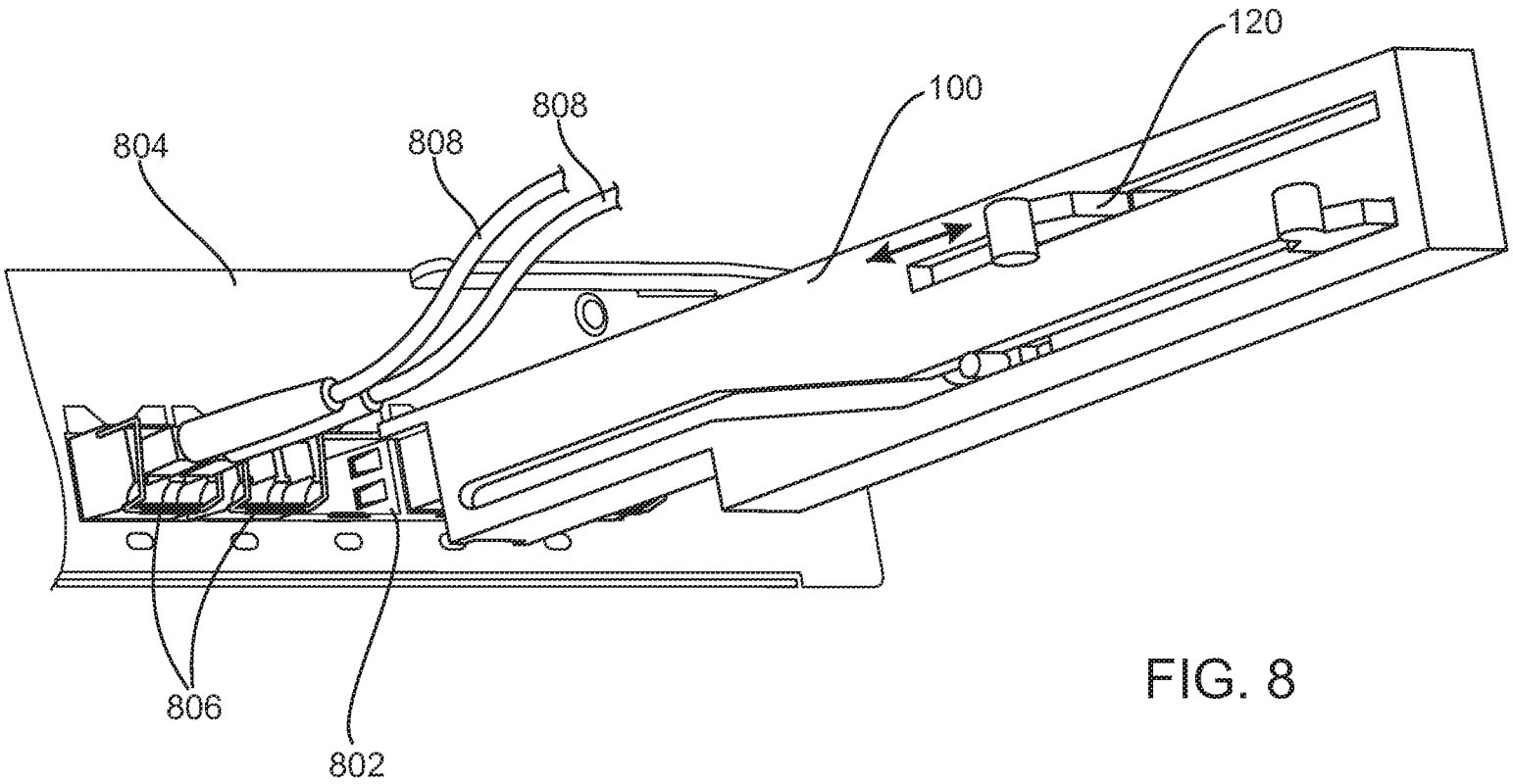
FIG. 8 illustrates a perspective view of a SFP being inserted into a networking device using a SFP tool in accordance with an exemplary embodiment.

At block 708, the SFP is inserted into the slot of the networking device. For example, an end of the SFP can be inserted into the slot of the networking device and the installer key handle 134 can be slid forward thereby inserting the SFP into the slot of the networking device. For example, as shown in FIG. 8, a SFP 802 is inserted into a slot of a networking device 804 with the insertion key handle 120 being slid towards the networking device 804. After inserting the SFP into the slot of the networking device, the method 700 can proceed to block 710.

At block 710, the SFP is decoupled from the SFP tool. For example, the one or more port engagers 128 can be removed from the corresponding ports on the SFP by pulling the installer key 120 away from the networking device and/or pulling the SFP tool away from the networking device. In addition, the bottom section, the section between the corresponding ports on the SFP and the bottom surface of the SFP, can be removed from the gap 132 of the SFP tool 100. After the SFP is decoupled from the SFP tool, the method 700 can proceed to block 712.

At block 712, the SFP can be locked into place. For example, a bail on the SFP can be locked into place by the user thereby securing the SFP into the slot of the networking device. FIG. 8 shows bails 806 of adjacent SFPs 802 in a locked position. One or more cables 808 can be inserted into one or more ports of the locked SFP 802.

Figure 9:
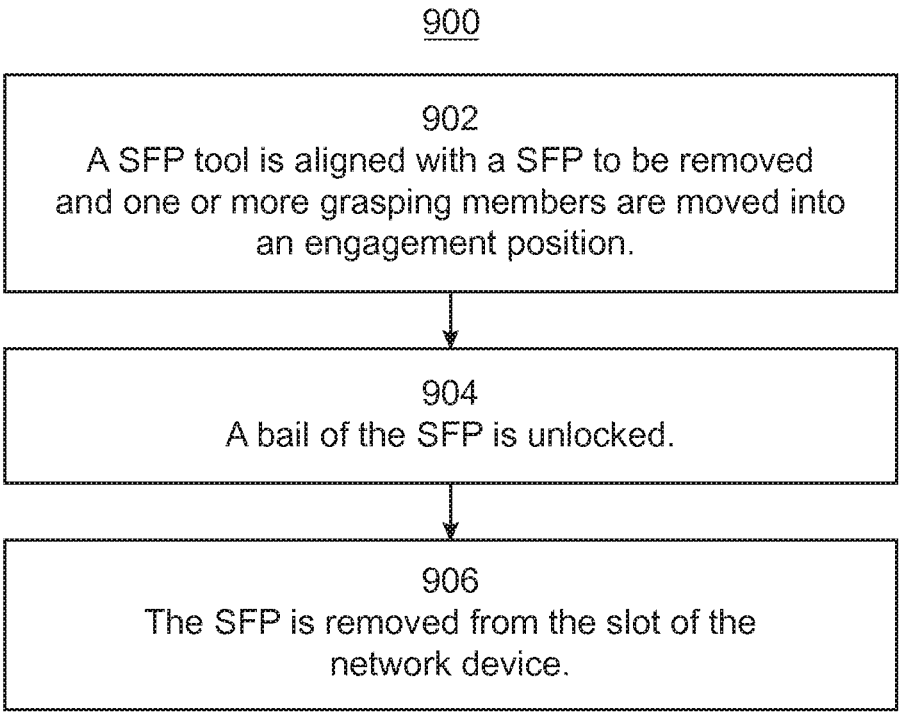
FIG. 9 illustrates a flow diagram for removing a SFP from a networking device using a SFP tool in accordance with an exemplary embodiment.

Referring to FIG. 9, a flowchart for removing a SFP from a networking device in accordance with an exemplary embodiment is illustrated. The exemplary method 900 is provided by way of example, as there are a variety of ways to carry out the method. The method 900 described below can be carried out using the SFP tool illustrated in FIGS. 1-6 by way of example, and various elements of these figures are referenced in explaining exemplary method 900. Each block shown in FIG. 9 represents one or more processes, methods or subroutines, carried out in the exemplary method 900. The exemplary method 900 can begin at block 902 with all of the cables removed from the one or more ports of the SFP.

At block 902, a SFP tool is aligned with a SFP to be removed and one or more grasping members are moved into an engagement position. For example, the alignment component 108 of the SFP tool 100 can be aligned with a SFP to be removed from a slot or a SFP slot of a networking device and the one or more grasping members 160 can be moved into an engagement position by moving the extractor key 150 into the extended position with the bail engager 154 angled as shown in FIG. 4. After aligning the SFP tool 100 and positioning the one or more grasping members 160 into an engagement position, the method 900 can proceed to block 904.

At block 904, a bail of the SFP is unlocked. For example, the extractor key handle 162 can be moved away from the networking device causing the one or more grasping members 160 to engage the bail of the SFP and move the bail in an unlocked position. Alternatively or in addition to the above, pressure can be applied to the extractor key handle 162 and the SFP tool 100 can be moved away from the networking device thereby unlocking the bail of the SFP to be removed. In some embodiments, the bail on the SFP can be positioned in a different orientation compared to the locked bails 806 shown in FIG. 10. For example, if the SFP 802 was rotated ninety degrees (90°), then the SFP tool 100 in FIG. 10 would be rotated ninety degrees (90°). After unlocking the bail, the method 900 can proceed to block 906.

Figure 10:
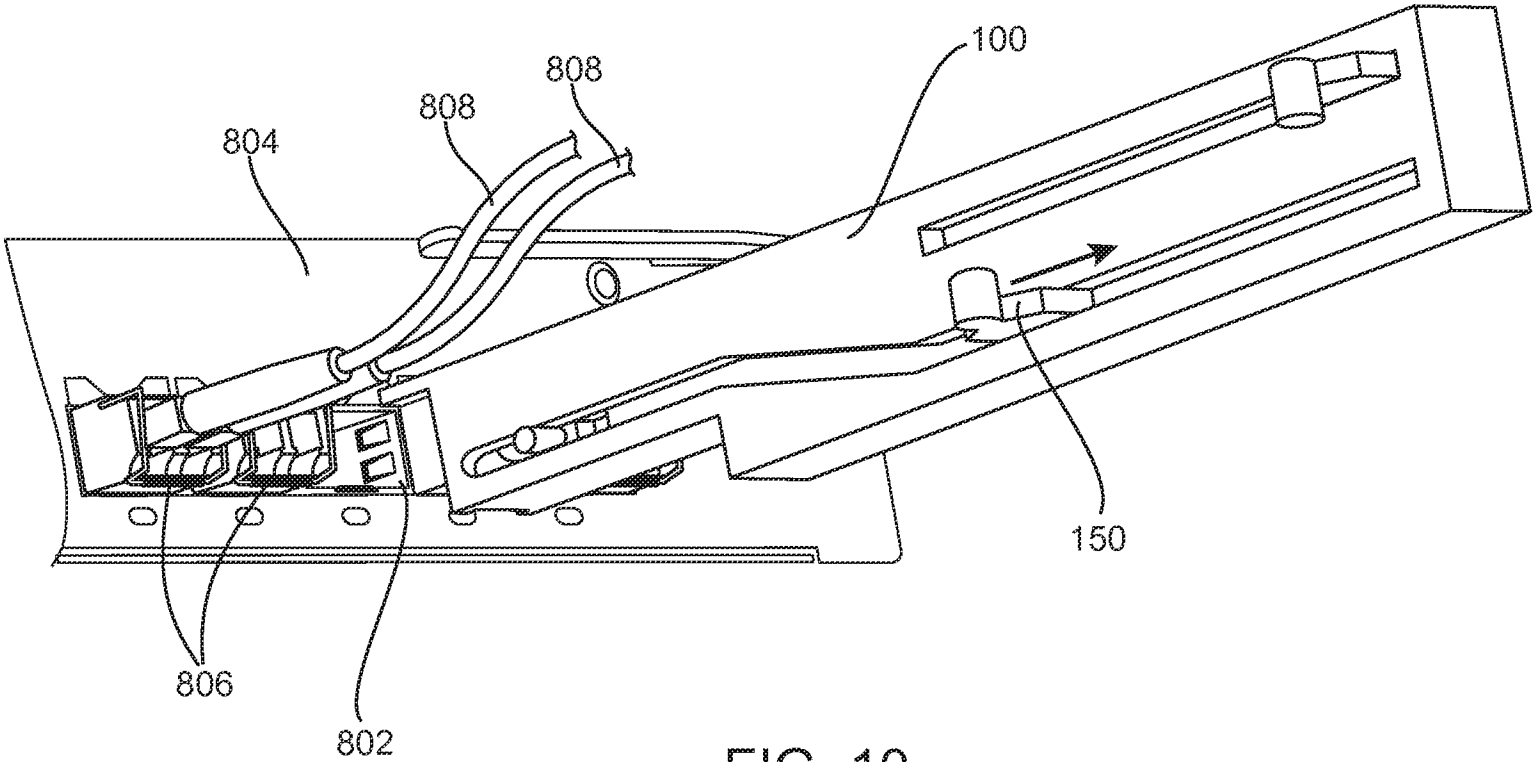
FIG. 10 illustrates a perspective view of an SFP being removed from a networking device using a SFP tool in accordance with an exemplary embodiment.

At block 906, the SFP is removed from the slot of the networking device. For example, the extractor key handle 162 can be moved further away from the networking device causing the extractor key 150 to be moved towards the retained position which allows the SFP to be partially retained in the cavity 112 of the tool body 102 as shown in FIG. 10. Alternatively or in addition to the above, pressure can be applied to the extractor key handle 162 and the SFP tool 100 can be moved away from the networking device thereby causing the SFP to be removed from the slot of the networking device.

In some embodiments, the SFP tool 100 can include an installer key 120 with no extractor key 150. In other embodiments, the SFP tool 100 can include an extractor key 150 with no installer key 120. In some embodiments, the SFP tool 100 can include two or more installer keys 120 and/or two or more extractor keys 150. In some embodiments, the one or more port engagers 128 can extend out of one distal end of the SFP tool 100 and the one or more grasping members 160 can extend out of the other distal end of the SFP tool 100. In some embodiments, the installer key handle 134 can be located in other locations or other means can be used to move the installer key 120. For example, the movement of the installer key 120 can be automated. In some embodiments, the extractor key handle 162 can be located in other locations or other means can be used to move the extractor key 150. For example, the movement of the extractor key 150 can be automated.

Although a variety of examples and other information was used to explain aspects within the scope of the appended claims, no limitation of the claims should be implied based on particular features or arrangements in such examples, as one of ordinary skill would be able to use these examples to derive a wide variety of implementations. Further and although some subject matter may have been described in language specific to examples of structural features and/or method steps, it is to be understood that the subject matter defined in the appended claims is not necessarily limited to these described features or acts. For example, such functionality can be distributed differently or performed in components other than those identified herein. Rather, the described features and steps are disclosed as examples of components of systems and methods within the scope of the appended claims.

The invention claimed is:

1. A small form-factor pluggable (SFP) tool comprising:
a tool body;
an installer key slidingly engaged with the tool body, the installer key comprising, at a first distal end, a port engager to engage with a corresponding port of a SFP during installation of the SFP into a networking device; and
an extractor key slidingly engaged with the tool body, the extractor key comprising a bail engager to engage with a bail of a SFP during removal of the SFP from a networking device, the bail engager pivotally coupled to at about a first distal end of the extractor key.

2. The SFP tool of claim 1 wherein at least a portion of the installer key resides in the tool body when the installer key is in a retracted position.

3. The SFP tool of claim 2 wherein the port engager resides in the tool body when the installer key is in a retracted position.

4. The SFP tool of claim 1 wherein the port engager comprises two port engagers each for engaging with a corresponding port of the SFP being installed.

5. The SFP tool of claim 1 wherein the installer key further comprises, at the first distal end, a protrusion, with both the protrusion and the port engager being parallel with each other, the protrusion to contact the SFP and to assist in maintaining an orientation of the SFP during installation of the SFP.

6. The SFP tool of claim 1 wherein:
the installer key, at a second distal end, further comprises a handle; and
the tool body further comprises a channel on each side of the tool body with the handle of the installer key extending out of the channel on each side of the tool body.

7. The SFP tool of claim 1 wherein at least a portion of the SFP resides in the tool body when the extractor key is in a retracted position.

8. The SFP tool of claim 7 wherein the bail engager resides in the tool body when the extractor key is in a retracted position.

9. The SFP tool of claim 1 wherein the bail engager comprises at least one hook to engage with a bail of the SFP during removal.

10. The SFP tool of claim 1 wherein:
the extractor key, at a second distal end, further comprises a extractor key handle; and
the body further comprises a channel on each side of the tool body with the extractor key handle of the extractor key extending out of the channel on each side of the tool body.

11. A small form-factor pluggable (SFP) tool comprising:
a tool body; and
an extractor key slidingly engaged with the tool body, the extractor key comprising a bail engager to engage with a bail of a SFP during removal of the SFP from a SFP module, the bail engager pivotally coupled to at about a first end of the extractor key.

12. The SFP tool of claim 11 wherein at least a portion of the SFP resides in the tool body when the extractor key is in a retracted position.

13. The SFP tool of claim 12 wherein the bail engager resides in the tool body when the SFP extractor key is in a retracted position.

14. The SFP tool of claim 11 wherein the bail engager comprises at least one hook to engage with a bail of the SFP during removal.

15. The SFP tool of claim 11 wherein:

the extractor key further comprises, at a second distal end, a handle; and the tool body further comprises a channel on each side of the body with the handle of the SFP extractor key extending out of the channel on each side of the tool body.

* * * * *